US009374646B2

(12) United States Patent
Li

(10) Patent No.: US 9,374,646 B2
(45) Date of Patent: Jun. 21, 2016

(54) BINAURAL ENHANCEMENT OF TONE LANGUAGE FOR HEARING ASSISTANCE DEVICES

(75) Inventor: Ning Li, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 383 days.

(21) Appl. No.: 13/601,573

(22) Filed: Aug. 31, 2012

(65) Prior Publication Data

US 2014/0064496 A1 Mar. 6, 2014

(51) Int. Cl.

| | |
|---|---|
| ***H04R 25/00*** | (2006.01) |
| ***G10L 21/0332*** | (2013.01) |
| ***G10L 21/0364*** | (2013.01) |
| ***G10L 25/90*** | (2013.01) |

(52) U.S. Cl.

CPC ..... *H04R 25/50* (2013.01); *G10L 21/0332* (2013.01); *G10L 21/0364* (2013.01); *H04R 25/552* (2013.01); *G10L 25/90* (2013.01)

(58) Field of Classification Search

CPC ..... G10L 25/93; G10L 15/02; G10L 15/09; G10L 15/04; G10L 21/0332; G10L 21/0364; H04R 25/552

See application file for complete search history.

(56) References Cited

U.S. PATENT DOCUMENTS

| | | | | |
|---|---|---|---|---|
| 5,610,908 | A * | 3/1997 | Shelswell et al. | 370/210 |
| 7,020,581 | B2 | 3/2006 | Dittberner | |
| 1,705,951 | A1 | 2/2010 | Grafenberg et al. | |
| 7,742,611 | B2 | 6/2010 | Grafenberg et al. | |
| 8,737,653 | B2 * | 5/2014 | Woods | 381/317 |
| 2004/0190734 | A1 * | 9/2004 | Kates | 381/106 |
| 2007/0030988 | A1 * | 2/2007 | Bauml et al. | 381/315 |
| 2007/0291969 | A1 * | 12/2007 | Tateno et al. | 381/315 |
| 2008/0159548 | A1 * | 7/2008 | Solum | 381/58 |
| 2010/0111338 | A1 * | 5/2010 | Ypma et al. | 381/314 |
| 2010/0183158 | A1 * | 7/2010 | Haykin et al. | 381/23.1 |
| 2010/0198586 | A1 * | 8/2010 | Edler et al. | 704/203 |

(Continued)

FOREIGN PATENT DOCUMENTS

| | | | |
|---|---|---|---|
| CN | 103686571 | A | 3/2014 |
| WO | WO-9508248 | A1 | 3/1995 |
| WO | WO-2007028250 | A2 | 3/2007 |

OTHER PUBLICATIONS

Nielsen et al., Pitch Based Sound Classification, 2006, IEEE, p. 788-791.*

(Continued)

*Primary Examiner* — Fan Tsang
*Assistant Examiner* — Angelica M McKinney
(74) *Attorney, Agent, or Firm* — Schwegman Lundberg & Woessner, P.A.

(57) ABSTRACT

Disclosed herein, among other things, are methods and apparatus for binaural enhancement of tone language for hearing assistance devices. One aspect of the present subject matter includes a method for enhancing pitch in a hearing assistance system having a first and second hearing assistance device. A signal is received using a microphone of the first hearing assistance device. Pitch detection is performed on the signal to obtain a pitch value. The pitch value is wirelessly transmitted from the first hearing assistance device to the second hearing assistance device. In various embodiments, the pitch value of the first hearing assistance device is combined with a pitch value of the second hearing assistance device. The gain is adjusted based on the combined pitch value, in various embodiments.

20 Claims, 3 Drawing Sheets

(56) References Cited

U.S. PATENT DOCUMENTS

| | | | | |
|---|---|---|---|---|
| 2011/0158442 | A1* | 6/2011 | Woods | 381/317 |
| 2014/0044291 | A1* | 2/2014 | Xia et al. | 381/321 |
| 2014/0185813 | A1* | 7/2014 | Ozden et al. | 381/23.1 |

OTHER PUBLICATIONS

Lin et al., Langugage Identification Using Pitch Contour Information, 2005, IEEE, p. 193-196.*

Krubsack et al., An Autocorrelation Pitch Detector and Voicing Decision with Confidence Measures Developed for Noise-Corrupted Speech, 1991, vol. 39, IEEE, p. 319-329.*

Nielsen et al., Pitch based sound classification, 2006, IEEE, p. 1-4.*

Krunsack et al., An Autocorrelation Pitch Dector and Voicing Decision with Confidence Measures Developed for Noise-Corrupted Speech, Feb. 1991, IEEE, vol. 39 No. 2, p. 1-11.*

"European Application Serial No. 13182498.9, Extended European Search Report mailed Nov. 25, 2013", 5 pgs.

"European Application Serial No. 13182498.9, Response filed Aug. 11, 2014 to Extended European Search Report mailed Nov. 25, 2013", 14 pgs.

Boersma, Paul, "Accurate Short-Term Analysis of the Fundamental Frequency and the Harmonics-to-Noise Ratio of a Sampled Sound", Institute of Phonetic Sciences, University of Amsterdam, Proceedings 17, (1993), 97-110.

Chou, Wen-Sheng, et al., "A binaural algorithm for space and pitch detection", 2011 IEEE International Conference on Acoustics, Speech and Signal Processing (ICASSP), (2011), 4976-4979.

Huang, Zezhen, et al., "A pattern recognition approach to four-tone classification of isolate words of standard colloquial Chinese", ACTA Acoustics, 15(1), (1990), 36-43.

Mitre, Adriano, et al., "Accurate and Efficient Fundamental Frequency Determination from Precise Partial Estimates", Proceedings of the 4th AES Brazil Conference, (2006), 113-118.

Noll, A. Michael, "Pitch Determination of Human Speech by the Harmonic Product Spectrum, the Harmonic Sum Spectrum and a Maximum Likelihood Estimate", Proceedings of the Symposium on Computer Processing in Communications, vol. XIX, Polytechnic Press, (1970), 779-797.

* cited by examiner

| Pinyin | Tone | Meaning |
|---|---|---|
| mā | first tone | mom |
| má | second tone | hemp |
| mǎ | third tone | horse |
| mà | fourth tone | scold |

EXAMPLE OF FOUR TONES IN MANDARIN

BINAURAL ENHANCEMENT OF TONE LANGUAGE FOR HEARING ASSISTANCE DEVICES

FIELD OF THE INVENTION

The present subject matter relates generally to hearing assistance systems and more particularly to binaural enhancement of tone language for hearing assistance devices.

BACKGROUND

Hearing assistance devices include a variety of devices such as assistive listening devices, cochlear implants and hearing aids. Hearing aids are useful in improving the hearing and speech comprehension of people who have hearing loss by selectively amplifying certain frequencies according to the hearing loss of the subject. A hearing aid typically has three basic parts; a microphone, an amplifier and a speaker. The microphone receives sound (acoustic signal) and converts it to an electrical signal and sends it to the amplifier. The amplifier increases the power of the signal, in proportion to the hearing loss, and then sends it to the ear through the speaker. Cochlear devices may employ electrodes to transmit sound to the patient.

A tone language like Mandarin, Cantonese or Thai is unlike English, because tone language relies on pitch discrimination for speech intelligibility. For example, Mandarin uses four tones to clarify the meanings of words: a first tone at a high level, a second rising tone, a third falling then rising tone, and a fourth falling tone. An example is shown in the table of FIG. 4. Since many characters have the same sound, tones are used to differentiate words from each other. The tones are discriminated by the pitch changes which are often limited to a small range in the low frequency spectrum.

For hearing-impaired listeners, even with the aid of a hearing assistance device, the pitch detection rate could drop due to insufficient spectrum resolution and hearing loss in low frequencies. This leads to poor speech intelligibility of a tone language for a wearer of a hearing assistance device.

Thus, there is a need in the art for an improved method and apparatus for enhancing tone language for hearing assistance devices.

SUMMARY

Disclosed herein, among other things, are methods and apparatus for binaural enhancement of tone language for hearing assistance devices. One aspect of the present subject matter includes a method for enhancing pitch in a hearing assistance system having a first and second hearing assistance device. A signal is received using a microphone of the first hearing assistance device. Pitch detection is performed on the signal to obtain a pitch value. The pitch value is wirelessly transmitted from the first hearing assistance device to the second hearing assistance device. In various embodiments, the pitch value of the first hearing assistance device is combined with a pitch value of the second hearing assistance device. The gain is adjusted based on the combined pitch value, in various embodiments.

Another aspect of the present subject matter includes a method for enhancing pitch in a hearing assistance system having a first and second hearing assistance device. In various embodiments, a time domain signal is sensed using a microphone of the first hearing assistance device. The time domain signal is converted to a frequency domain signal and pitch detection is performed on the frequency domain signal to obtain a pitch contour value and a pitch detection confidence of the first hearing assistance. The pitch contour value and the pitch detection confidence are wirelessly transmitted from the first hearing assistance device to the second hearing assistance device. In various embodiments, the pitch detection contour value of the first hearing assistance device is combined with a pitch detection contour value of the second hearing assistance device using the pitch detection confidence of the first hearing assistance device and a pitch detection confidence of the second hearing assistance device. The tone is classified based on the combined pitch contour value and gain is adjusted based on the tone classification, in various embodiments.

A further aspect of the present subject matter includes a hearing assistance system. The system includes a first hearing assistance device in a first ear of a wearer and a second hearing assistance device in a second ear of the wearer. In various embodiments, the first hearing assistance device is configured to receive a signal, perform pitch detection on the signal to obtain a pitch value, and wirelessly transmit the pitch value to the second hearing assistance device. The second hearing assistance device is configured to combine the pitch value of the first hearing assistance device with a pitch value of the second hearing assistance device, and adjust gain based on the combined pitch value, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Modern hearing assistance devices, such as hearing aids typically include a processor, such as a digital signal processor in communication with a microphone and receiver. Such designs are adapted to perform a great deal of processing on sounds received by the microphone. These designs can be highly programmable and may use inputs from remote devices, such as wired and wireless devices.

Figures 3, 4:
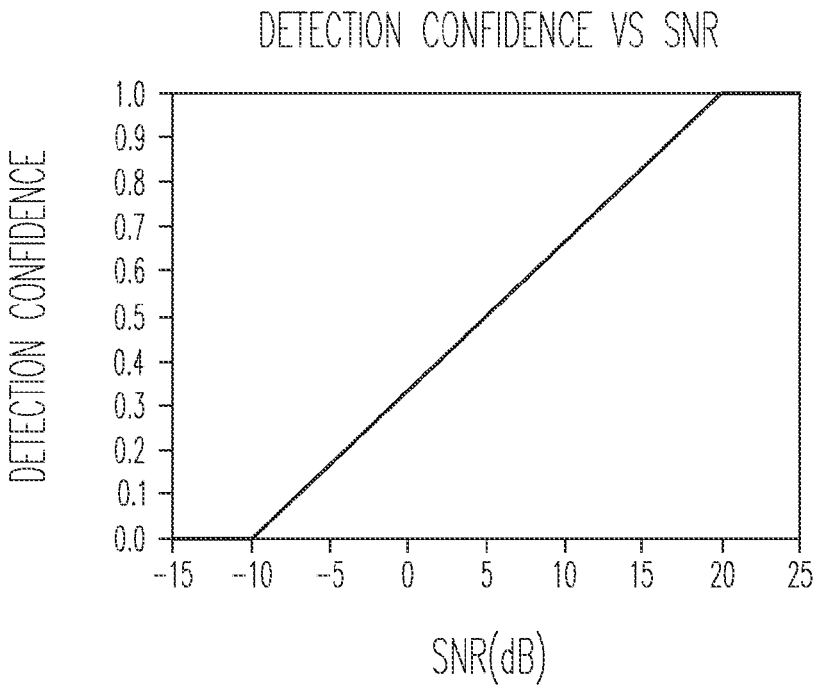
FIG. 3 is a graphical diagram illustrating pitch detection confidence in a binaural pitch enhancement based system for hearing assistance devices, according to one embodiment of the present subject matter.
FIG. 4 is a table illustrating the meaning of various tones in a tone language.

A tone language like Mandarin, Cantonese or Thai is unlike English, because tone language relies on pitch discrimination for speech intelligibility. For example, Mandarin uses four tones to clarify the meanings of words: a first tone at a high level, a second rising tone, a third falling then rising tone, and a fourth falling tone. An example is shown in the table of FIG. 4. Since many characters have the same sound, tones are used to differentiate words from each other. The tones are discriminated by the pitch changes which are limited to a small range in the low frequency spectrum. In some cases the changes of fundamental frequency ($V(k,n)=O_n$) could be smaller than 100 Hz. However, for hearing-impaired listeners, even with the aid of a hearing assistance device, the pitch detection rate could drop due to insufficient spectrum resolution and hearing loss in low frequencies. This leads to poor speech intelligibility of a tone language for a wearer of a hearing assistance device.

Previous solutions include focusing on detecting the fundamental frequency contour for each side (each ear) of the hearing devices and enhancing the signal for each side separately. Disadvantages of these previous solutions include that: (1) the processing of the two sides is independent of each other, which may lead to non-synchronization of the tone detection; (2) since the processing is done for each side separately, it does not take advantage of binaural pitch detection; and (3) for some adverse conditions, like noisy conditions, the monaural processing cannot benefit from the other ear if it has a stronger received target signal.

The present subject matter uses binaural pitch detection, and provides robust pitch detection to improve speech understanding for tone language for hearing impaired listeners who wear binaural hearing devices. Information from both left and right sides is used to enhance the pitch detection for tone language. In one embodiment, information from one hearing assistance device (one side or ear) is combined with information from a second hearing assistance device (second side or ear) to detect pitch. In another embodiment, pitch is detected from each side and transferred to the other side to get more accurate pitch contour information.

Disclosed herein, among other things, are methods and apparatus for binaural enhancement of tone language for hearing assistance devices. One aspect of the present subject matter includes a method for enhancing pitch in a hearing assistance system having a first and second hearing assistance device. A signal is received using a microphone of the first hearing assistance device. Pitch detection is performed on the signal to obtain a pitch value. The pitch value is wirelessly transmitted from the first hearing assistance device to the second hearing assistance device. In various embodiments, the pitch value of the first hearing assistance device is combined with a pitch value of the second hearing assistance device. The gain is adjusted based on the combined pitch value, in various embodiments.

Figure 1:
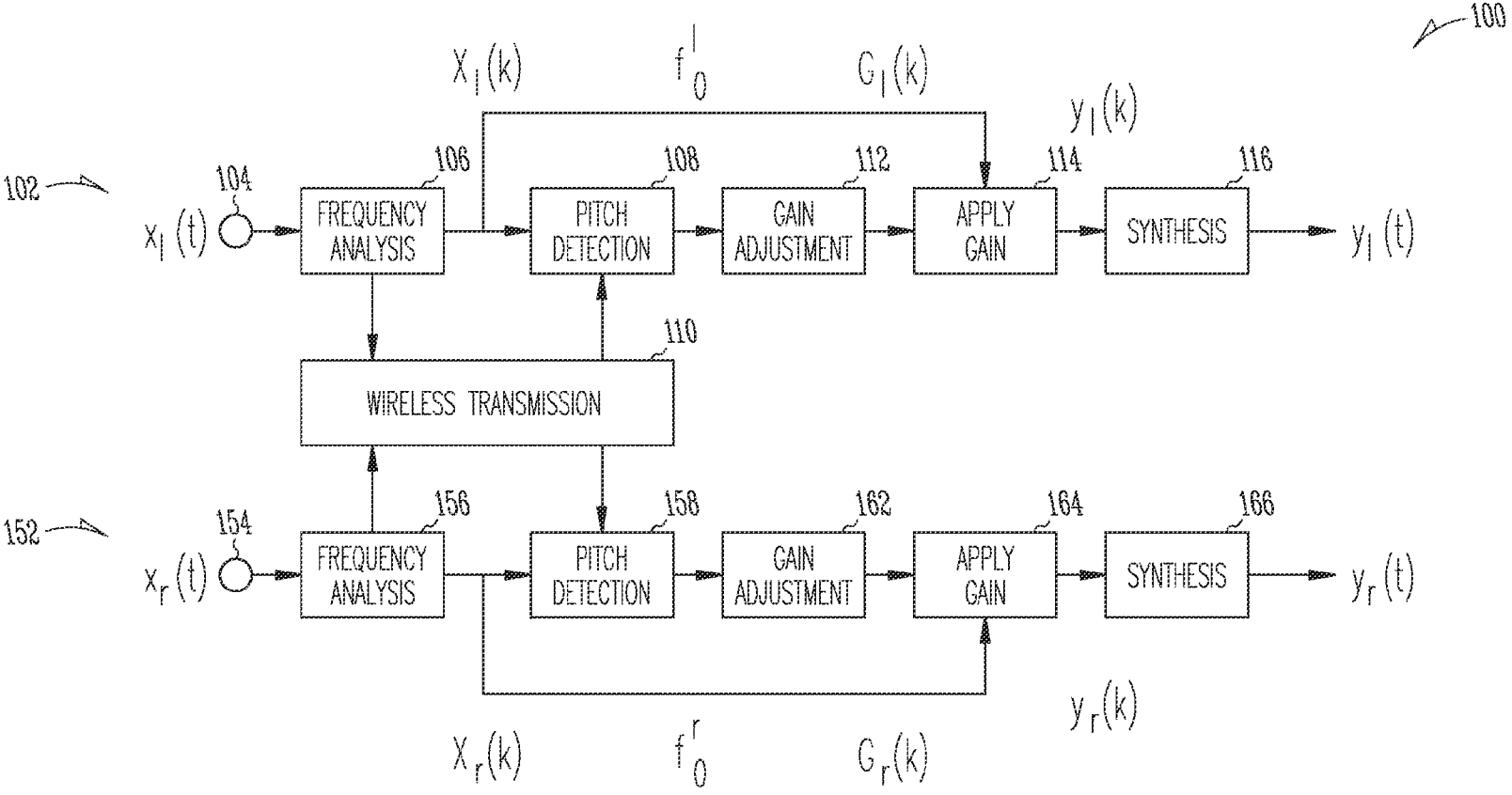
FIG. 1 is a flow diagram illustrating a binaural pitch detection based system for hearing assistance devices, according to one embodiment of the present subject matter.

FIG. 1 is a flow diagram illustrating a binaural pitch detection based system for hearing assistance devices, according to one embodiment of the present subject matter. The system includes a first hearing assistance device 102 in a left ear of a wearer and a second hearing assistance device 152 in a right ear of the wearer. The basic blocks in the depicted system 100 include frequency analysis 106, 156, wireless transmission 110, pitch detection 108, 158, gain adjustment 112, 162, gain application 114, 164, and synthesis 116, 166. The frequency analysis block 106, 156 converts the time-domain signal picked up by the microphones 104, 154 to a frequency domain signal, in various embodiments. For example, it could be realized by Discrete Fourier Transform (DFT) or other frequency analysis methods. The wireless transmission block 110 transfers the signal from one side (or ear) to the other side. The pitch detection block 108, 158 takes the signals from both sides to generate the pitch contour detection. In various embodiments, time domain and/or frequency domain methods can be utilized for pitch detection. Examples of frequency domain methods include, but are not limited to, the harmonic product spectrum and cepstral analysis. The gain adjustment block 112, 162 first determines the tone based on the pitch contour. In various embodiments, the signal is classified into one of several groups of tones based on the slope of the pitch contour.

$$S_f = \frac{\Delta f_0}{\Delta f}$$

(The slope of pitch contour, Δt is the duration)

In a tone language such as Mandarin for example (see FIG. 4), $S_f>0$ for the second tone while $S_f<0$ for the fourth tone. For certain languages, it may also combine this information with the length of the syllables. After classifying the tone, the gain estimation can be adjusted based on the tone category, in various embodiments. For certain tones, emphasizing the gain in the low frequencies can improve the speech understanding. The gain application block 114, 164 applies the adjusted gain in the frequency domain, in an embodiment. In various embodiments, the synthesis block 116, 166 converts the signal back to time domain. Other blocks are included, in various embodiments. For example, for hearing aids, the compressor, the feedback canceller and noise reduction blocks are used and can affect gain. A relatively large data rate is used since the whole signal is needed for the implementation. To limit the bit rate, the wireless link can be activated as needed for the non-constant speech segment. In addition, instead of transferring the whole frequency range, an embodiment limits transfers to the low frequencies.

Figure 2:
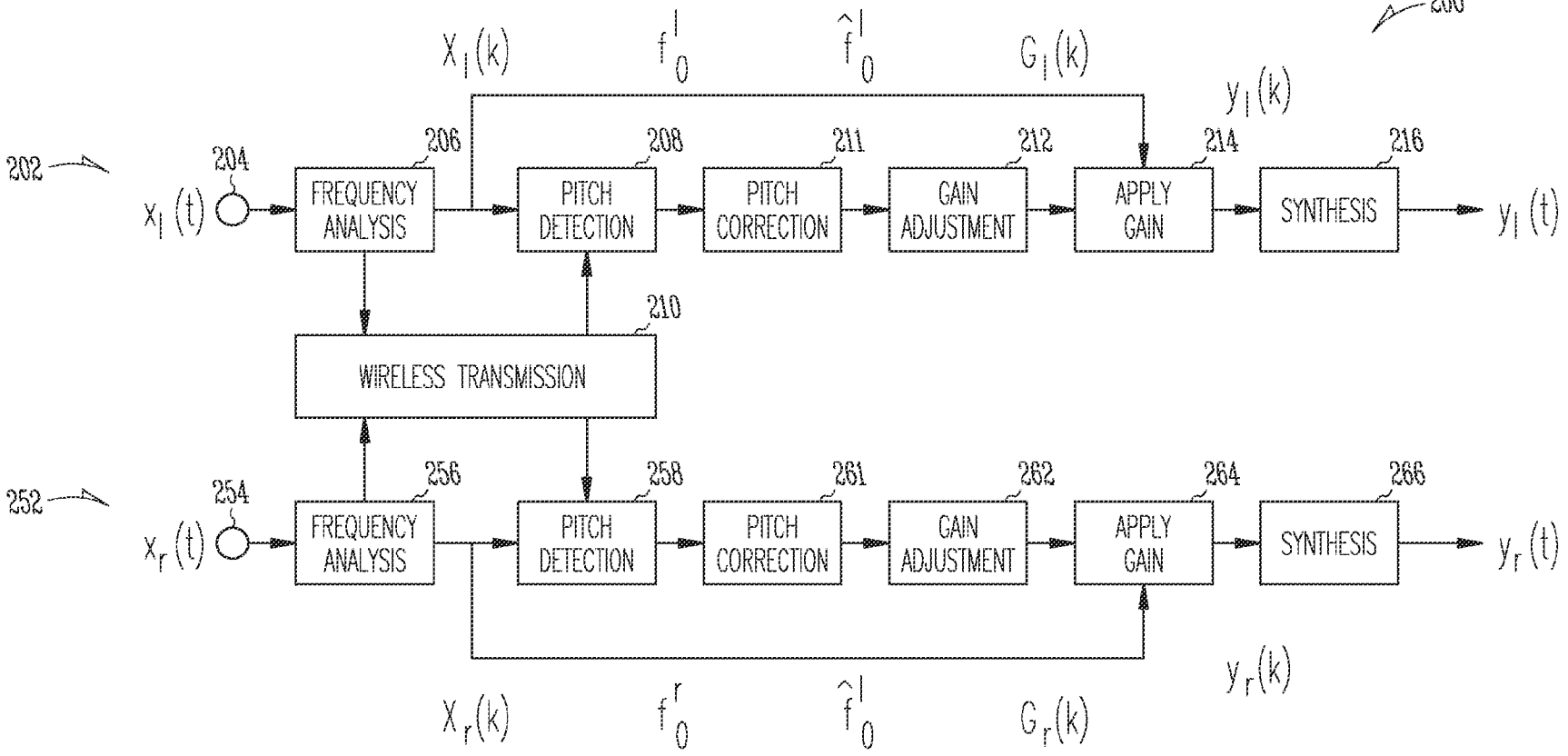
FIG. 2 is a flow diagram illustrating a binaural pitch enhancement based system for hearing assistance devices, according to one embodiment of the present subject matter.

FIG. 2 is a flow diagram illustrating a binaural pitch enhancement based system for hearing assistance devices, according to one embodiment of the present subject matter. In various embodiments, the system of FIG. 2 improves on the system of FIG. 1 by reducing computation cost and decreasing sensitivity in noisy environments. The system includes a first hearing assistance device 202 in a left ear of a wearer and a second hearing assistance device 252 in a right ear of the wearer. The basic blocks in the depicted system 200 include frequency analysis 206, 256, wireless transmission 210, pitch detection 208, 258, pitch correction 211, 261, gain adjustment 212, 262, gain application 214, 264, and synthesis 216, 266. The frequency analysis block 206, 256 converts the time-domain signal picked up by the device microphones 204, 254 to a frequency domain signal. For example, it could be realized by Discrete Fourier Transform (DFT) or other frequency analysis methods. The wireless transmission block 210 transfers the pitch detection results from one side to the other side. The pitch detection block 208, 258 can be implemented in several ways. Frequency-domain algorithms include a harmonic product spectrum, a maximum likelihood which attempts to match the frequency-domain characteristics to pre-defined frequency maps and the detection of peaks due to harmonic series. For the pitch detection block, the present subject matter also measures the detection confidence.

$$c=f(\mathrm{SNR})$$

The detection confidence is a function of signal-to-noise ratio (SNR). The higher the SNR, the more confident the detection result is, in various embodiments.

$$SNR(n) = \max(\min(SNR(n), T1), T2)$$

$$c(n) = \frac{SNR(n) - T1}{T2 - T1}$$

T1 and T2 are used to limit the SNR value, and the value of c(n) is in the range 0 to 1, in various embodiments. The detection confidence is transferred to the other side (the device in the other ear of the user) with the pitch contour value, in various embodiments.

FIG. 3 is a graphical diagram illustrating pitch detection confidence in a binaural pitch enhancement based system for hearing assistance devices, according to one embodiment of the present subject matter. The diagram depicts pitch detection confidence versus SNR, using an example with T1=−10 dB and T2=20 dB. The detection confidence can also be calculated using non-linear functions.

The present subject matter provides pitch correction, in various embodiments. The pitch correction block 211, 261 combines pitch values from the two sides (from a device in a left ear and a device in a right ear) according to the determined pitch detection confidence. In one embodiment, the pitch values are combined using the following equation:

$$f_0(n) = \frac{c_l(n)}{c_l(n) + c_r(n)} f_0^l(n) + \frac{c_r(n)}{c_l(n) + c_r(n)} f_0^r(n)$$

If both $c_l(n)=c_r(n)=0$

For the left side: $f_0(n)=f_0^l(n)$

For the right side: $f_0(n)=f_0^r(n)$

In various embodiments, the gain adjustment block 212, 262 first determines the tone based on the pitch contour. The signal is classified into one of several groups of tones based on the slope of the pitch contour, in various embodiments.

$$S_f = \frac{\Delta f_0}{\Delta t}$$

(the slope of pitch contour, Δt is the duration)

In the example of the tone language Mandarin (FIG. 4), $S_f>0$ for the second tone while $S_f<0$ is the fourth tone. For certain languages, it may also be combined with the length of the syllable. After classifying the tone, the gain estimation is adjusted based on the tone category, in various embodiments. For certain tones, the gain in the low frequencies is emphasized to improve the speech understanding. The gain application block 214, 264 applies the adjusted gain in the frequency domain, in an embodiment. In various embodiments, the synthesis block 216, 266 converts the signal back to time domain. Other blocks are included, in various embodiments. For example, for hearing aids, the compressor, the feedback canceller and noise reduction blocks are used and can affect gain.

The system of FIG. 2 has several advantages. One advantage that a relatively low data rate can be used since only the pitch and the detection confidence are needed for the implementation. In addition, the bit rate can be further limited by activating the wireless link only for the non-constant speech segment. Further, since pitch changes slowly compared to the signal itself, it can be decimated and coded efficiently before the transmission. Therefore, the present subject matter has a low computation cost comparing to the binaural pitch detection, and is robust to noisy environments in various embodiments.

The present subject matter is demonstrated for hearing aids, but can be used in any hearing assistance device. In various embodiments, a detection score can be calculated using other methods as long as it represents the confidence score of how pitch is estimated. The pitch correction can be implemented other than combining of pitch for two sides in various embodiments, as long as it can benefit from the information of both sides, especially taking advantage of the better ear (high SNR side).

Another aspect of the present subject matter includes a method for enhancing pitch in a hearing assistance system having a first and second hearing assistance device. In various embodiments, a time domain signal is sensed using a microphone of the first hearing assistance device. The time domain signal is converted to a frequency domain signal and pitch detection is performed on the frequency domain signal to obtain a pitch contour value and a pitch detection confidence of the first hearing assistance. The pitch contour value and the pitch detection confidence are wirelessly transmitted from the first hearing assistance device to the second hearing assistance device. In various embodiments, the pitch detection contour value of the first hearing assistance device is combined with a pitch detection contour value of the second hearing assistance device using the pitch detection confidence of the first hearing assistance device and a pitch detection confidence of the second hearing assistance device. The tone is classified based on the combined pitch contour value and gain is adjusted based on the tone classification, in various embodiments.

A further aspect of the present subject matter includes a hearing assistance system. The system includes a first hearing assistance device in a first ear of a wearer and a second hearing assistance device in a second ear of the wearer. In various embodiments, the first hearing assistance device is configured to receive a signal, perform pitch detection on the signal to obtain a pitch value, and wirelessly transmit the pitch value to the second hearing assistance device. The second hearing assistance device is configured to combine the pitch value of the first hearing assistance device with a pitch value of the second hearing assistance device, and adjust gain based on the combined pitch value, in various embodiments.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11(wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications standards, protocols, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. It is understood that in various embodiments the microphone is optional. It is understood that in various embodiments the receiver is optional. Thus, the examples set forth herein are intended to be demonstrative and not a limiting or exhaustive depiction of variations.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevet, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for enhancing pitch in a hearing assistance system having a first and second hearing assistance device, the method comprising:

receiving a signal using a microphone of the first hearing assistance device;

performing pitch detection on the signal to obtain a pitch value;

wirelessly transmitting the pitch value from the first hearing assistance device to the second hearing assistance device;

combining the pitch value of the first hearing assistance device with a detected pitch value of the second hearing assistance device using pitch detection confidence determined based on signal-to-noise ratio of the first hearing assistance device and the second hearing assistance device, including classification based on a slope of a pitch contour value; and adjusting gain based on the combined pitch value to improve understanding of speech.

2. The method of claim 1, wherein combining the pitch value of the first hearing assistance device with the pitch value of the second hearing assistance device includes using pitch correction.

3. The method of claim 1, wherein performing pitch detection on the signal to obtain a pitch value includes determining a pitch contour value.

4. The method of claim 1, further comprising:

applying the adjusted gain to the signal to obtain an enhanced signal.

5. The method of claim 4, further comprising:

playing the enhanced signal using a receiver.

6. The method of claim 2, wherein using pitch correction includes combining pitch values from the first and second hearing assistance device using pitch detection confidence.

7. The method of claim 6, wherein using pitch detection confidence includes determining a first hearing assistance device pitch detection confidence and a second hearing assistance device pitch detection confidence.

8. The method of claim 6, wherein the pitch detection confidence is a function of signal-to-noise ratio (SNR).

9. The method of claim 6, wherein the pitch detection confidence is calculated using a non-linear function.

10. The method of claim 7, further comprising:

wirelessly transmitting the first hearing assistance device pitch detection confidence from the first hearing assistance device to the second hearing assistance device.

11. A method for enhancing pitch in a hearing assistance system having a first and second hearing assistance device, the method comprising:

sensing a time domain signal using a microphone of the first hearing assistance device;

converting the time domain signal to a frequency domain signal;

performing pitch detection on the frequency domain signal to obtain a pitch contour value and a pitch detection confidence of the first hearing assistance;

wirelessly transmitting the pitch contour value and the pitch detection confidence from the first hearing assistance device to the second hearing assistance device;

combining the pitch detection contour value of the first hearing assistance device with a detected pitch detection contour value of the second hearing assistance device using the pitch detection confidence based on signal-to-noise ratio of the first hearing assistance device and a pitch detection confidence based on signal-to-noise ratio of the second hearing assistance device;

classifying the tone based on the combined pitch contour value, including classification based on a slope of the combined pitch contour value; and adjusting gain based on the tone classification to improve understanding of speech.

12. The method of claim 11, further comprising:

applying the adjusted gain to the frequency domain signal.

13. The method of claim 11, wherein wirelessly transmitting the pitch contour value and the pitch detection confidence includes using a Bluetooth™ wireless communication protocol.

14. The method of claim 11, wherein wirelessly transmitting the pitch contour value and the pitch detection confidence includes using IEEE 802.11, 802.15 or 802.16.

15. The method of claim 11, wherein wirelessly transmitting the pitch contour value and the pitch detection confidence includes using a cellular protocol such as CDMA or GSM.

16. The method of claim 11, wherein wirelessly transmitting the pitch contour value and the pitch detection confidence includes using ultra-wideband (UWB) technology.

17. The method of claim 12, further comprising:

converting the frequency domain signal back to an adjusted time domain signal.

18. The method of claim 17, further comprising:

playing the adjusted time domain signal using a receiver.

19. A hearing assistance system, comprising:

a first hearing assistance device in a first ear of a wearer; and a second hearing assistance device in a second ear of the wearer, wherein the first hearing assistance device is configured to:

receive a signal;

perform pitch detection on the signal to obtain a pitch value; and wirelessly transmit the pitch value to the second hearing assistance device, and wherein the second hearing assistance device is configured to:

combine the pitch value of the first hearing assistance device with a detected pitch value of the second hearing assistance device using pitch detection confidence determined based on signal-to-noise ratio of the first hearing assistance device and the second hearing assistance device, including classification based on a slope of a pitch contour value; and adjust gain based on the combined pitch value to improve understanding of speech.

20. The hearing assistance system of claim 19, wherein the first and second hearing assistance devices include first and second hearing aids.

* * * * *